United States Patent [19]

Jones

[11] Patent Number: 5,004,046

[45] Date of Patent: Apr. 2, 1991

[54] HEAT EXCHANGE METHOD AND APPARATUS

[75] Inventor: Brian C. Jones, Windsor, Conn.

[73] Assignee: Thermodynetics, Inc., Windsor, Conn.

[21] Appl. No.: 535,755

[22] Filed: Jun. 11, 1990

[51] Int. Cl.[5] ..... F28D 7/12

[52] U.S. Cl. ..... 165/156; 62/394; 62/399; 165/169

[58] Field of Search ..... 62/394, 399; 165/156, 165/169

[56] References Cited

U.S. PATENT DOCUMENTS

| | | | |
|---|---|---|---|
| 2,235,244 | 3/1941 | Ames et al. | 62/399 X |
| 2,324,257 | 7/1943 | Ekert | 165/156 X |
| 2,536,404 | 1/1951 | Walker | 165/156 X |
| 2,821,844 | 2/1958 | Olson | 62/394 X |
| 3,435,627 | 4/1965 | Castillo | 62/394 X |
| 3,474,636 | 10/1969 | Bligh | 62/394 X |
| 3,605,421 | 9/1971 | Patrick | 62/394 X |
| 3,730,229 | 5/1973 | D'Onofrio | 165/156 X |
| 3,739,842 | 6/1973 | Whalen | 62/399 X |
| 4,061,184 | 12/1977 | Radcliffe | 62/394 X |
| 4,437,319 | 3/1984 | Iannelli | 62/399 X |

*Primary Examiner*—Lloyd L. King

*Attorney, Agent, or Firm*—Chilton, Alix & Van Kirk

[57] ABSTRACT

A compact and efficient heat exchanger is defined by three coaxial tubes, the intermediate tube being spirally fluted and in intimate contact with inner and outer tubes. The resulting three walled tubular structure defines a spiral vent passage and double wall separation between inner and outer flow paths. The three walled structure may be formed into an evaporator coil for use in a water cooler.

22 Claims, 2 Drawing Sheets

HEAT EXCHANGE METHOD AND APPARATUS

BACKGROUND OF THE INVENTION

1. Field of the Invention

The present invention relates to the transfer of thermal energy to or from a fluid and particularly to the chilling of potable water. More specifically, this invention is directed to apparatus for exchanging heat between a pair of fluids, one of which is disposed in or being delivered to a reservoir, and especially to direct expansion-type evaporators for use in the chilling of liquids. Accordingly, the general objects of the present invention are to provide novel and improved methods and apparatus of such character.

2. Description of the Prior Art

While not limited thereto in its utility, the present invention is particularly well suited to employment in drinking water fountains for the chilling of potable water. The conventional manner of chilling water for such drinking fountain use utilizes mechanical refrigeration to remove heat from potable water contained in a cylindrical reservoir. Thus, heat is removed from the water by an evaporator, the heat subsequently being discharged to the atmosphere via a condenser. The evaporator in such conventional coolers will typically comprise metal tubing wrapped in a spiral around the outside of the water reservoir. As refrigerant evaporates inside the tubing, a low temperature is developed and, accordingly, thermal energy will migrate from the higher temperature potable water through the reservoir wall and the tubing wall, and will be transferred into the refrigerant. As this heat migration occurs, the temperature of the potable water in the reservoir will be reduced.

The tubing comprising the evaporator has, in the prior art, typically been wrapped around the outside of the reservoir, rather than being submersed within the potable water, because safety codes require an atmospherically vented, double wall separation between the refrigerant, which is toxic, and the potable water. With such double wall separation, external leakage of either the refrigerant or the potable water would be signified by the flow of either fluid into the atmospherically vented space between the walls. It therefore follows that a commercially available atmospherically vented, double-walled tube could be immersed in a reservoir of potable water and refrigerant circulated through the inner conduit of the double-walled tube. In such case, if a leak in the inner refrigerant conducting conduit were to develop, the refrigerant would vent to the atmosphere through the space defined about the inner conduit by a coaxial outer conduit and would not contaminate the water.

In the above-described conventional water chilling evaporator, in the drinking water fountain environment, a reserve volume or reserve capacity of chilled water is contained by the reservoir. This reserve capacity is required to accommodate instantaneous demand for chilled water when the drinking fountain is used. When the reserve capacity of chilled water is depleted, i.e., when the water in the reservoir becomes warm due to the warm temperature of the inflowing water which replaces outflowing chilled water, the refrigeration system must be capable of chilling the water in the reservoir to a given temperature within a given recovery time. The physical size of conventional water chilling evaporators is proportional to the reserve capacity of the apparatus and inversely proportional to the recovery time. While it is beneficial to maximize reserve capacity and minimize the recovery time, the physical size of such conventional evaporators is often larger than deemed acceptable or desirable.

It is also to be observed that the above-described prior art method and apparatus of water chilling is inefficient because of a heat transfer resistance, known in the art as contact resistance, which exists between the wall of the reservoir and the evaporator tubing. Another related inefficiency of the above-described prior art is that water contained within the reservoir is for all practical purposes stagnant, i.e., water velocity across the inner wall of the reservoir is so low that the film coefficient of heat transfer is seriously impaired. As a result of both of these effects, i.e., contact resistance and impaired film coefficient, the overall heat transfer coefficient is diminished and the evaporator is typically oversized with very long lengths of coiled tubing and an oversized potable water reservoir in an attempt to achieve the desired recovery time and reserve capacity. The oversizing of the evaporator tubing and reservoir increases the size, weight and cost of the water cooler.

Theoretically, the efficiency of a direct expansion water chilling evaporator could be enhanced by immersing the tubing coil directly within the chilled water reservoir to eliminate the contact resistance. However, as noted above, conventional single wall tubing would be unacceptable because of the requirement for vented double wall separation between the refrigerant and potable water as dictated by safety considerations. As also noted above, the requirement for vented, double wall separation could theoretically be met through the use of commercially available double wall heat transfer tubing, spirally fluted double wall tubing for example, which could be coiled and immersed within a water reservoir. In such case, any leak in either the inner or outer tube wall would result in the migration of the fluid passing through the leak to the tube ends where the leak would vent to the atmosphere.

When compared to conventional tubing, a spirally fluted double wall tube has a much higher heat transfer efficiency as a result of its inherently low contact resistance between the two tube walls. The inherently low contact resistance is the result of a good mechanical bond which is promoted by a high degree of contact pressure between the two tube walls. Thus, at first glance, it might appear that acceptable water chilling in a drinking fountain could be accomplished through the use of spirally fluted, double wall tubing which is formed into a coil and immersed in the reservoir and vented. This, however, is not the case since the heat transfer from the chilled water would be limited by the fact that the water would be approximately stagnant on the outside surface of the fluted tube. Restated, because of the insignificantly low velocity of water flow over the surface of the spirally fluted outer tube, the film coefficient on the outer surface of the fluted tube would be seriously impaired, thus resulting in an unacceptably low overall heat transfer coefficient.

SUMMARY OF THE INVENTION

The present invention overcomes the above briefly-discussed and other deficiencies and disadvantages of the prior art and, in so doing, provides a heat exchanger characterized by efficiency, compactness and cost effectiveness. A heat exchanger in accordance with the present invention is fabricated from a novel three walled tube structure. The inner tube of this three walled tube structure will typically have a smooth inner wall and will define a first flow path which customarily conveys a low temperature refrigerant. The inside diameter of the inner tube is selected, with consideration to the flow rate of low temperature refrigerant, so as to ensure a velocity of adequate degree so as to promote a high film coefficient. A spirally fluted intermediate tube is formed about the smooth walled inner tube so as to provide a mechanical bond between the inner tube and the inside ridges of the spirally fluted intermediate tube. The outer of the three tube walls defines a jacket which encases the fluted intermediate tube in such a manner as to provide strong contact pressure between the outer ridges of the spirally fluted intermediate tube and the inside surface of the jacket. The space formed between the jacket and the fluted intermediate tube defines a non-linear second flow path which typically conveys fluid being delivered to a reservoir. The non-linear second flow path is configured so as to insure that, taking fluid flow rate and source pressure into account, the velocity and turbulence of the fluid flowing therethrough will be sufficient to promote a high film coefficient.

The three walled tube structure may be formed into a coil which is immersed in a reservoir. The vent space formed between the spirally fluted intermediate tube and the inner tube will be exposed at one or both ends to the exterior of the reservoir. A first fluid, a refrigerant for example, will be delivered to the inner tube and will flow through the coil and will exit the inner tube outside of the reservoir. A second fluid, potable water for example, will be caused to flow through the coil following the second flow path, the flow of the second fluid typically being in an opposite direction to that of the first fluid, and will be subsequently discharged into the reservoir. The fluid flow in both flow paths, the refrigerant conveying first flow path and the non-linear second flow path, will be turbulent, thus resulting in respectively high film coefficients. There will also be a low contact resistance between the inner ridges of the spirally fluted intermediate tube and the inner tube due to the inherent contact pressure. Accordingly, there will be efficient transfer of thermal energy between the first and second fluids. Also, because of the contact pressure formed between the outer ridges of the spirally fluted intermediate tube and jacket which promotes a low contact resistance, there will be an additional heat transfer path via the process of thermal conduction through the three walled tube structure between fluid in the reservoir in which the coil is immersed and the fluid which flows in the first flow path.

BRIEF DESCRIPTION OF THE DRAWING

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
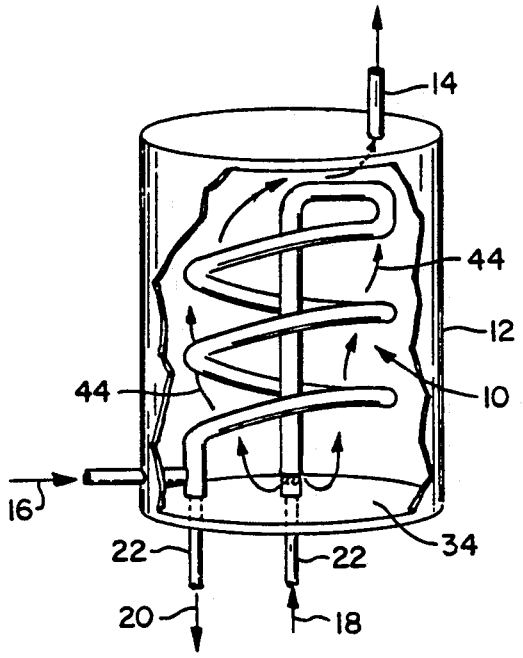
FIG. 1 is a schematic representation of a direct expansion water chilling evaporator in accordance with a preferred embodiment of the present invention.
Figure 2:
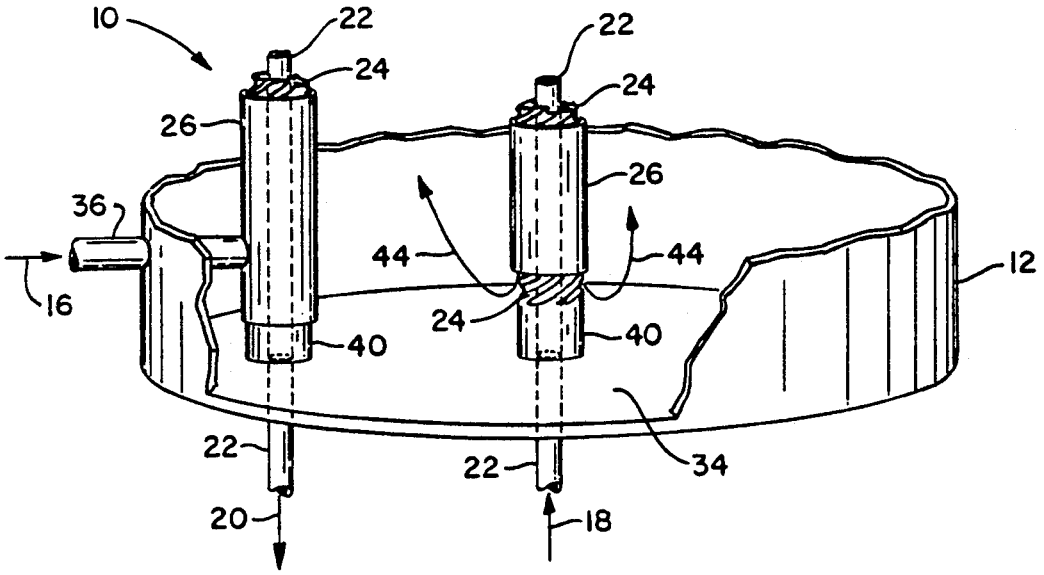
FIG. 2 is an enlarged view of the lower portion of the evaporator of FIG. 1.

With reference now to the drawing, a heat exchange coil or evaporator in accordance with the present invention is indicated generally at 10 in FIG. 1. As will be explained in greater detail below, evaporator 10 is formed from three coaxial tubes which are formed into a helix, typically having a constant diameter, to define a coil. In the arrangement shown, the evaporator 10 is positioned within a tank, i.e., a reservoir shell, indicated generally at 12. While not the only arrangement possible, the reservoir shell 12 will typically be of cylindrical shape and the evaporator 10 and reservoir shell 12 will be arranged coaxially. Considering a drinking fountain or water cooler environment, the reservoir shell 12 will be provided with an outlet 14 for chilled water, an inlet 16 for warm water, an inlet 18 for refrigerant which is delivered to evaporator 10 from an expansion device, and an outlet 20 for the refrigerant, outlet 20 typically being connected to compressor suction.

Figure 4:
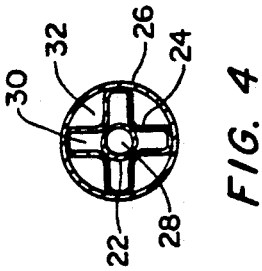
FIG. 4 is a cross-sectional view taken along line 4—4 perpendicular to the showing of FIG. 3.
Figure 3:
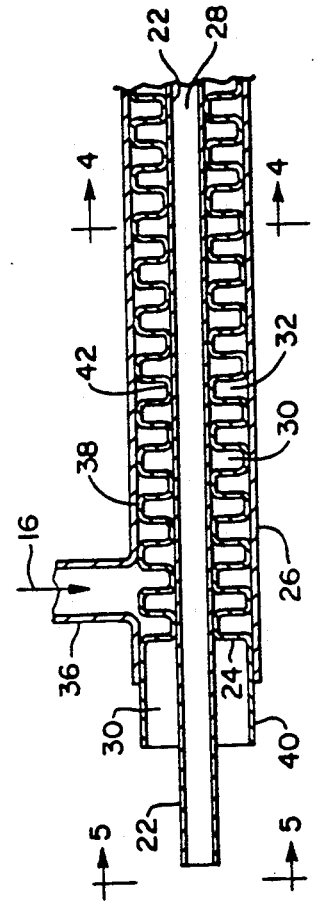
FIG. 3 is a cross-sectional side elevation view, taken along line 6—6 of FIG. 5, of one of the straight portions of the three walled tube which forms an evaporator coil for use in the practice in the present invention, the straight portions of the tube also being depicted in FIG. 2.
Figure 5:
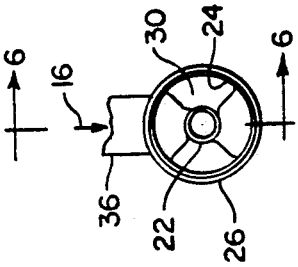
FIG. 5 is an end view taken along line 5—5 of FIG. 3.
Figure 7:
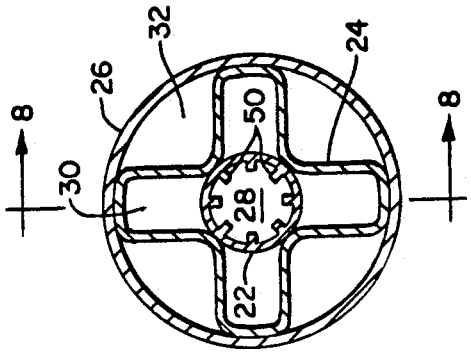
FIG. 7 is a cross-sectional end view taken along line 7—7 of FIG. 6.
Figure 6:
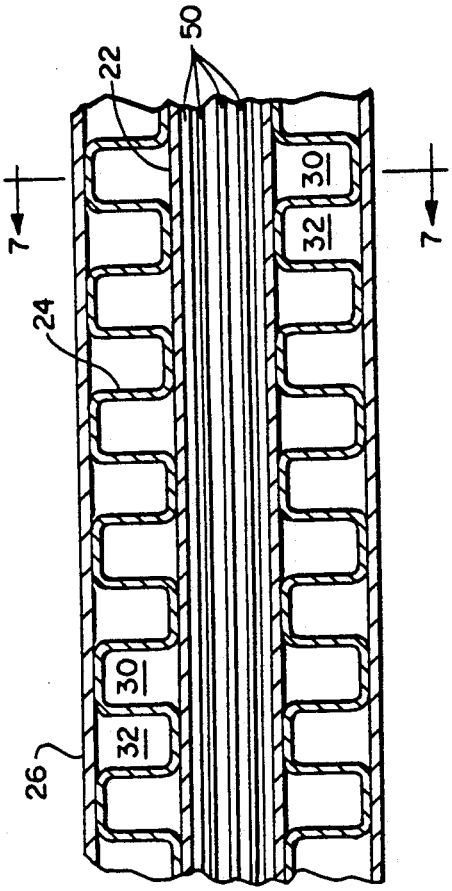
FIG. 6 is a view similar to FIG. 3, but on an enlarged scale, of a portion of a modified form of the heat exchanger of the present invention, FIG. 6 being a view taken along line 8—8 of FIG. 7.

The evaporator 10 is fabricated by forming an intermediate portion of a length of the three walled tubular structure shown in FIGS. 3, 4 and 5 into a tightly wound helix. The tubular structure includes an inner tube 22, a spirally fluted intermediate tube 24, characterized by outer ridges 38 and inner ridges 42, and a smooth walled outer tube or jacket 26. In the embodiment of FIGS. 1-5, the inner tube 22 is smooth-walled. However, as shown in FIGS. 6 and 7, the inside surface of tube 22 may be provided with fins or ridges 50 which promote turbulent flow to thereby insure a high film coefficient and to increase the inside heat transfer surface area. In both disclosed embodiments; a compressive forming process is used to form a mechanical contact pressure between jacket 26 and the outer ridges 38 of intermediate tube 24, and likewise between inner ridges 42 of intermediate tube 24 and inner tube 22. The inner tube 22 defines a first flow path 28 and a first extension of tube 22 defines the refrigerant inlet 18. A second, oppositely disposed extension of tube 22 defines the refrigerant outlet 20. The inner ridges 42 of spirally fluted tube 24 are, as a consequence of the compressive forming process as noted, tightly pressed against tube 22 and a spirally shaped vent passage 30 is thus defined between tubes 22 and 24. Likewise, jacket 26 will, due to the compressive forming process as mentioned above, be in intimate contact with the outer ridges 38 of spirally fluted tube 24. Consequently, a second spiral flow path 32, which follows the contour of the vent space, will be formed between tubes 24 and 26. Flow path 28, vent passage 30 and flow path 32 are fluidically isolated from one another. In the disclosed embodiment, both the refrigerant inlet and outlet extend through the bottom 34 of reservoir shell 12. The opposite plain diameter ends 40 of the spirally fluted tube 24, which undergo a transition to a round cylindrical shape, will be sealed to the bottom of the reservoir shell about the respective refrigerant inlet and outlet. Accordingly, the vent space between tubes 22 and 24 will be in communication with the exterior atmosphere of the reservoir shell.

A warm water inlet conduit 36 extends through the wall of the reservoir shell 12 and through the wall of jacket 26. Conduit 36 is sealed to both the reservoir and jacket. The inlet conduit 36 establishes fluid communication between the warm water supply, not shown, and the flow path 32 between tube 24 and jacket 26 at a point disposed upstream, in the direction of incoming water flow, at the beginning of the spiral fluting of tube 24. The jacket 26 terminates within reservoir shell 12 at both ends and is sealed, for example by brazing, to the smooth end portion 40 of the spirally fluted tube 24 at a first end of the jacket located adjacent the conduit 36. The second end of jacket 26 is not sealed and thus opens into the reservoir. Accordingly, the incoming water will follow a spiral flow path, in the space between tube 24 and jacket 26, along the length of the helical evaporator coil, from bottom to top in the environment disclosed. In the environment disclosed, where the evaporator 10 has a straight tube portion 46 extending from the top of the coil downwardly towards the bottom of the reservoir, the water will continue to follow the spiral flow path formed between jacket 26 and fluted tube 24 and will flow into the reservoir adjacent the bottom thereof through the open end of the jacket as indicated by flow arrows 44 in FIG. 2. The refrigerant will flow through the evaporator 10 in inner tube 22 generally in the opposite direction to the direction of incoming water flow. It is within the scope of the invention that the terms "top" and "bottom" are relative and the evaporator coil may be oriented upside down or sideways relative to the orientation of the disclosed embodiment.

To describe the operation of the disclosed embodiment of the invention, warm water delivered to the apparatus depicted in the drawings flows along the space between the fluted tube 24 and the jacket 26. Since the jacket 26 is terminated prior to the end of the fluted tube length, the chilled water will empty directly into the reservoir upon reaching the end of the evaporator coil which is disposed opposite to the water inlet. A relatively high water velocity is maintained over the surface of the fluted tube in flow path 32 while a desired refrigerant velocity is maintained through the inner tube 22. These oppositely directed and maintained flow velocities, coupled with the creation of turbulent flow, establish high film coefficients which, in combination with the low contact resistance, results in maintenance of a high overall heat transfer coefficient. Accordingly, higher heat transfer performance is attained during operation when there is an instantaneous demand for chilled water than has been possible in the prior art. Conversely, performance commensurate with the prior art can be achieved within a smaller envelope since the length of the tubing comprising the evaporator and the reserve volume of the reservoir shell can be minimized.

Intimate contact is, as noted above, also established between the outer ridges 38 of the spirally fluted tube 24 and the inside of the jacket 26. Thus, when there is no water draw on the system, there will nevertheless be good heat transfer between the refrigerant and water in the reservoir via the process of thermal conduction through the three walled structure, although this heat transfer is accomplished at a lower efficiency than is achieved when water is flowing. Thus, the heat exchanger has the capability of chilling water in the reservoir regardless of whether or not there is an instantaneous chilled water demand, i.e., whether or not there is water flowing. The combination of the aforementioned performance benefits and enhancements results in a heat exchanger with superior performance when compared to conventional designs when there is instantaneous demand, and also provides a reserve volume of chilled water in the reservoir to accommodate a prolonged instantaneous demand. Furthermore, when there is no instantaneous demand, but the reservoir water requires further chilling, the heat exchanger has the capability to provide the needed chilling capability.

It should be understood that the present invention is not limited to the chilling of water or other fluids. For example, the invention is equally applicable to the heating of fluids. Regardless of the end use, the present invention is characterized by a very high heat transfer coefficient when fluid is flowing through the flow passage 32 between tubes 24 and 26 and by the ability to transfer heat between fluid within reservoir shell 12 and inner conduit 28 even when there is no flow within flow passage 32. A heat exchanger in accordance with the invention is also characterized by compactness, light weight and cost effectiveness.

While the evaporator coil for use in the practice of the present invention will typically be comprised of copper, other materials having adequate ability to conduct heat, and particularly metals such as stainless steel, carbon steel, Cupro-nickel, aluminum and brass, can be employed. Similarly, the reservoir shell can be fabricated from any material which is suitable for the end use. Thus, if the reservoir shell is to contain potable water, it will typically be fabricated from a material such as copper, stainless steel or plastic.

While a preferred embodiment has been shown and described, various modifications and substitutions may be made thereto without departing from the spirit and scope of the invention. For example, the three walled tube need not be formed into a helical coil and/or a four tube arrangement can be employed with the fourth tube being coaxial with the three walled tube structure and defining the reservoir. Accordingly, it is to be understood that the present invention has been described by way of illustration and not limitation.

What is claimed is:

1. A heat exchange method comprising the steps of:

directing a first fluid along a non-linear first flow path from an external source to the interior of a reservoir, the first flow path being at least in part disposed within the reservoir;

directing a second fluid along a second flow path which is at least in part disposed within the reservoir, there being double wall separation between the flow paths whereby the first and second flow paths are hermetically isolated from one another and a space which is generally parallel to the first flow path is defined, the first and second flow paths being in intimate heat transfer relationship with one another, the second flow path being in communication with the exterior of the reservoir at both ends thereof;

causing the flow along at least the first flow path to be turbulent; and venting any leakage from the second flow path to the ambient atmosphere at the exterior of the reservoir via the space which is generally parallel to the first flow paths.

2. The method of claim 1 wherein the first flow path at least in part defines a spiral about the second flow path.

3. The method of claim 2 wherein both of said first and second flow paths are at least in part generally helical.

4. The method of claim 3 further comprising the step of:

causing the flow in the first and second flow paths to be in opposite directions.

5. The method of claim 2 further comprising the step of:

causing the flow in the first and second flow paths to be turbulent and in opposite directions.

6. Apparatus for transferring thermal energy between a pair of isolated liquids comprising:

reservoir means for temporarily storing a quantity of a first liquid;

heat exchanger means for defining a pair of fluidically isolated flow paths, said heat exchanger means being at least in part immersed in said reservoir, said heat exchanger means including:

an inner conduit, said inner conduit defining a first flow path for a second liquid, said first flow path having first and second ends;

an intermediate conduit, said intermediate conduit in part comprising a spirally fluted tube in intimate contact with the exterior of said inner conduit whereby a double wall separation is defined between the interior of said inner conduit and the exterior of said fluted tube, said fluted tube cooperating with said inner conduit to define a first spiralled space therebetween; and an outer conduit, the interior of said outer conduit being in intimate contact with said fluted tube, said outer conduit cooperating with said fluted tube to define a second spiralled space between said outer conduit and fluted tube, said second space comprising a portion of a second flow path, said outer conduit being sealed to said intermediate conduit at a first end of said outer conduit, said second flow path communicating with the interior of said reservoir means;

means for delivering said first fluid to the interior of said outer conduit at a point adjacent to said outer conduit first end whereby said first fluid flows along said second flow path and is discharged into said reservoir means;

means for delivering said second fluid to said inner conduit at a first end of said first flow path, said delivering means extending into said reservoir means;

means for receiving said second fluid from said inner conduit at the second end of said first flow path, said receiving means extending into said reservoir means;

means for withdrawing said first liquid from said reservoir means; and means for venting said first spiralled space to the exterior of said reservoir means.

7. The apparatus of claim 6 wherein said delivering and receiving means comprise extensions of said inner conduit.

8. The apparatus of claim 7 wherein said intermediate conduit has a constant diameter portion at each of the opposite ends of said spirally fluted tube, said constant diameter portions being hermetically sealed to said reservoir means to thereby establish fluid communication between the exterior of said reservoir means and said first spiralled space.

9. The apparatus of claim 8 wherein said heat exchanger means is in part in the form of a helical coil whereby said first flow path is in part helical and a portion of said second flow path is in the form of a spiral about said helical first flow path.

10. The apparatus of claim 6 wherein said intermediate conduit has a constant diameter portion at each of the opposite ends of said spirally fluted tube, said constant diameter portions being hermetically sealed to said reservoir means to thereby establish fluid communication between the exterior of said reservoir means and said first spiralled space.

11. The apparatus of claim 6 wherein said heat exchanger means is in part in the form of a helical coil whereby said first flow path is in part helical and a portion of said second flow path is in the form of a spiral about said helical first flow path.

12. The apparatus of claim 10 wherein said heat exchanger means is in part in the form of a helical coil whereby said first flow path is in part helical and a portion of said second flow path is in the form of a spiral about said helical first flow path.

13. The apparatus of claim 6 wherein said reservoir means comprises a holding tank for potable water and wherein said delivery and receiving means respectively conduct a refrigerant to and from said heat exchanger means.

14. The apparatus of claim 6 wherein said heat exchanger means conduits are sized to insure turbulent flow in at least said second flow path.

15. The apparatus of claim 13 wherein said heat exchanger means conduits are sized to insure turbulent flow in said first and second flow path.

16. The apparatus of claim 14 wherein said heat exchanger means is in part in the form of a helical coil whereby said first flow path is in part helical and a portion of said second flow path is in the form of a spiral about said helical part of said first flow path.

17. The apparatus of claim 16 wherein said venting means establishes fluid communication between said first spiralled space and the ambient atmosphere.

18. The apparatus of claim 17 wherein said reservoir means comprises a generally cylindrical tank and said coil and said tank are approximately coaxial.

19. The apparatus of claim 18 wherein said reservoir means comprises a holding tank for potable water and wherein said delivery and receiving means respectively conduct a refrigerant to and from said heat exchanger means.

20. The apparatus of claim 19 wherein said delivering and receiving means comprise extensions of said inner conduit.

21. The apparatus of claim 6 wherein said inner conduit has an irregular inner surface to promote turbulence in fluid flowing therethrough.

22. The apparatus of claim 20 where said inner conduit has an irregular inner surface to promote turbulence in fluid flowing therethrough.

* * * * *

UNITED STATES PATENT AND TRADEMARK OFFICE

CERTIFICATE OF CORRECTION

PATENT NO. : 5,004,046

DATED : April 2, 1991

INVENTOR(S) : Brian Carter Jones

It is certified that error appears in the above-identified patent and that said Letters Patent is hereby corrected as shown below:

Column 1, lines 28 and 29, change "evaporates inside the tubing" to -- flows through the inside of the tubing and evaporates.

Column 1, line 30, cancel "will.

Column 1, line 30, change "migrate" to -- migrates -- .

Column 1, line 32, change "will be" to -- is -- .

Column 1, line 34, change "will be" to -- is -- .

Column 4, line 46, cancel "inside".

Column 4, line 47, after "area" insert -- within inner tube 22 -- .

Column 4, line 47, after "embodiments" delete the period.

Column 7, line 4:
Claim 1, line 22, change "paths" to -- path -- .

UNITED STATES PATENT AND TRADEMARK OFFICE

CERTIFICATE OF CORRECTION

PATENT NO. : 5,004,046

DATED : April 2, 1991

INVENTOR(S) : Brian Carter Jones

It is certified that error appears in the above-identified patent and that said Letters Patent is hereby corrected as shown below:

Column 8, after line 67, insert the following additional claim:

--23. The apparatus of claim 6, wherein said reservoir means comprises a generally cylindrical tank and wherein said heat exchanger has an axis, the axes of said tank and heat exchanger being approximately coaxial.--.

Signed and Sealed this

Third Day of November, 1992

*Attest:*

*Attesting Officer*

DOUGLAS B. COMER

*Acting Commissioner of Patents and Trademarks*